US007217227B2

(12) United States Patent
Finn

(10) Patent No.: US 7,217,227 B2
(45) Date of Patent: May 15, 2007

(54) PORTABLE DEVICE FOR ASSISTING CHIN-UP AND DIP EXERCISES

(76) Inventor: Gregory M Finn, Foundry Cottage Ramsbury, Marlborough, Wiltshire (GB) SN8 2QD ( * ) Notice: Subject to any disclaimer, the term of this patent is extended or adjusted under 35 U.S.C. 154(b) by 164 days.

(21) Appl. No.: 10/735,939

(22) Filed: Dec. 15, 2003

(65) Prior Publication Data

US 2004/0127339 A1 Jul. 1, 2004

Related U.S. Application Data

(63) Continuation-in-part of application No. 10/456,546, filed on Jun. 9, 2003.

(60) Provisional application No. 60/387,139, filed on Jun. 8, 2002.

(51) Int. Cl.
*A63B 22/10* (2006.01)

(52) U.S. Cl. ..... 482/92; 482/38; 482/129

(58) Field of Classification Search ..... 482/125, 482/126, 81, 139, 92, 51, 24, 38–40, 43, 482/66, 69, 77, 121–124, 130, 143, 129
See application file for complete search history.

(56) References Cited

U.S. PATENT DOCUMENTS 1,952,750 A * 3/1934 Gailey ..... 482/125
3,752,473 A 8/1973 LaLanne
4,111,414 A 9/1978 Roberts
4,335,875 A 6/1982 Elkin
4,441,707 A 4/1984 Bosch
4,781,374 A 11/1988 Lederman
4,852,874 A 8/1989 Sleichter, III et al.
4,949,956 A 8/1990 Pobran
5,011,139 A 4/1991 Towley, III
5,042,796 A 8/1991 Jibril
5,108,096 A 4/1992 Ponce
5,190,512 A * 3/1993 Curran ..... 482/124
RE34,212 E 4/1993 Potts
5,322,489 A 6/1994 Webb et al.
5,328,432 A 7/1994 Gvoich
5,362,295 A * 11/1994 Nurge ..... 482/124
5,372,556 A 12/1994 Ropp
5,407,404 A 4/1995 Killian et al.
5,499,959 A 3/1996 Holmes et al.
5,514,059 A 5/1996 Romney
5,518,486 A 5/1996 Sheeler
5,674,163 A * 10/1997 Sennett ..... 482/125
5,681,248 A 10/1997 Vani (Continued)

OTHER PUBLICATIONS

Schuler, Lou, et al., The Men's Health Home Workout Bible, 2002, p. 81, Rodale Inc., USA.

(Continued)

*Primary Examiner*—Henry J. Recla

(57) ABSTRACT

An upper body exercise apparatus for assisting an exerciser in performing chin-ups and dips. The apparatus includes at least two securely yet releasably attached elastic stretch components connected to a substantially inelastic flexible component that functions as a suspended sling. The method of exercise is to engage part of the body within the sling to allow the elastic resistance to counteract a portion of the exercisers body weight and thus enable the exerciser to perform these effective body weight exercises with less effort than that required with the exerciser's full body weight.

20 Claims, 5 Drawing Sheets

U.S. PATENT DOCUMENTS

| | | | | |
|---|---|---|---|---|
| 5,776,033 | A | 7/1998 | Brown | |
| 5,839,994 | A | 11/1998 | Elbogen | |
| 5,871,422 | A | 2/1999 | Elbogen | |
| 5,941,802 | A * | 8/1999 | Kiser | 482/92 |
| 6,059,696 | A * | 5/2000 | Bohmer et al. | 482/54 |
| 6,179,748 | B1 | 1/2001 | Barr | |
| 6,244,998 | B1 | 6/2001 | Hinds | |
| 6,368,258 | B1 | 4/2002 | Emlaw | |
| 6,575,876 | B1 * | 6/2003 | Phelps-McMillon | 482/51 |
| 6,648,804 | B2 * | 11/2003 | Chen | 482/125 |

OTHER PUBLICATIONS http://www.lifeline-usa.com/site_uploads/product/23_1.pdf (see attachment).

* cited by examiner

PORTABLE DEVICE FOR ASSISTING CHIN-UP AND DIP EXERCISES

CROSS-REFERENCE TO RELATED APPLICATIONS

The present application is a continuation in part of U.S. patent application Ser. No. 10/456,546 filed Jun. 9, 2003, and entitled "Multi-Function Fitness Device" that in turn claimed priority to Provisional Application No. 60/387,139 filed on Jun. 8, 2002, and entitled "Exercise Aid and Gym Towel." U.S. patent application Ser. No. 10/456,546 is incorporated by reference in this application.

STATEMENT REGARDING FEDERALLY SPONSORED RESEARCH OR DEVELOPMENT

N/A

BACKGROUND OF THE INVENTION

This invention relates to exercise equipment and more particularly to a highly functional and portable exercise apparatus that can provide both assistance for some body weight exercises as well as added resistance for a number of common exercise maneuvers.

References:

| U.S. Patent Documents | | |
|---|---|---|
| Re. 34,212 | April 1993 | Potts |
| 3,752,473 | August 1973 | LaLanne |
| 4,111,414 | September 1978 | Roberts |
| 4,335,875 | June 1982 | Elkin |
| 4,441,707 | April 1984 | Bosch |
| 4,781,374 | November 1988 | Lederman |
| 4,852,874 | August 1989 | Sleichter, III et al. |
| 4,949,956 | August 1990 | Pobran |
| 5,011,139 | April 1991 | Towley, III |
| 5,042,796 | August 1991 | Jibril |
| 5,108,096 | April 1992 | Ponce |
| 5,322,489 | June 1994 | Webb et al. |
| 5,328,432 | July 1994 | Gvoich |
| 5,372,556 | December 1994 | Ropp |
| 5,407,404 | April 1995 | Killian et al. |
| 5,499,959 | March 1996 | Holmes et al. |
| 5,514,059 | May 1996 | Romney |
| 5,518,486 | May 1996 | Sheeler |
| 5,681,248 | October 1997 | Vani |
| 5,776,033 | July 1998 | Brown |
| 5,839,994 | November 1998 | Elbogen |
| 5,871,422 | February 1999 | Elbogen |
| 6,179,748 | January 2001 | Barr |
| 6,244,998 | June 2001 | Hinds |
| 6,368,258 | April 2002 | Emlaw |

Other Publications:

The Men's Health Home Workout Bible, Lou Schuler, et al., p. 81, 2002, Rodale Inc., USA Exercising in the gym, home and on travel is growing in popularity due in part to the awareness of the health benefits derived from regular exercise regimes. A wide variety of venues, equipment and associated activities exist for such purposes.

Through exercise individuals build and tone their muscles by performing multiple exercise repetitions using various pieces of equipment, however many exercises require very little equipment and some are performed with nothing more than the exerciser's own body weight. These so-called "body weight exercises" are generally multi-joint movements that substantially contribute to overall muscular development, balance, coordination and core strength. Not only do the chin-up and the dip represent some of the best exercises from this category, they represent some of the best exercises—period. Yet most individuals can't perform them because they require great upper body strength.

The chin-up (or for equivalent purposes here—the pull-up) is one of the best exercises for the upper back and arms. It is performed when the user grasps an overhead bar or other appropriate apparatus and raises himself/herself from a fully extended hanging position to a fully raised position when the user's chin in substantially at the same vertical position as the user's hands. The chin-up is a full body weight exercise that is so difficult that the vast majority of the population is unable to perform even a single repetition.

The dip is another highly beneficial full body weight exercise. It is used for building the chest, arms and shoulders and it is most often performed on a pair of sturdy, separated parallel handles from where the user supports and balances his entire hanging body on straight, stiff arms extended down along his sides. By bending the arms at the elbow the user lowers his body as far as possible and then pushes his full body weight straight up by straightening the arms for a single repetition. Like the chin-up, the dip is also difficult and very few people have the ability to perform a single repetition.

Chin-up and dip exercise equipment is readily available and accessible so that chin-ups and dips can be performed in gyms and fitness centers as well as in the home and anywhere appropriate apparatus can be found. Common equipment provided to use for these exercises include overhead bars for chin-ups and separated parallel handles for dips. This equipment can be simple and dedicated or it may be integrated with other exercise stations. A standard bar across a doorway for chin-ups or a pair of handles attached to a set of upright supports for dips are all that is necessary to perform these exercises. Other types of devices have emerged such as U.S. Pat. No. 6,179,748 to Barr, where a different type of doorjamb engaging device is described. However, gyms, fitness centers and larger home multi-station pieces of exercise equipment may provide chin-up and/or dipping stations along with other exercise stations as in U.S. Pat. No. 4,781,374 to Lederman that discloses such a piece of equipment.

Therefore, a multi-function device with the ability to assist an exerciser perform a chin-up and/or a dip and which is also portable and adaptable for use on the variety of different types of chin-up and/or dip stations provided for use in gyms and the home would help many individuals gain from the benefits of these exercises.

Assisted means for performing chin-ups and dips are not only highly useful for those individuals whom can't perform the body weight exercises on their own, they are also very useful for individuals whom have reached fatigue with unassisted exercises and wish to carry on with post fatigue exercise repetitions with a lower percentage of body weight. In either case the assistance provided helps the exerciser perform the full range of motion exercise, whereas unaided these repetitions would not have been performed and the associated muscle building and toning benefits left unachieved.

However, assisted means for performing chin-ups and dips are well known. By providing the ability to perform the chin-up or dip with less effort than that required to lift the entire exerciser's body weight, an exerciser can perform more repetitions of these highly beneficial exercises. A common method of self-assistance involves placing a chair or other sturdy object under a chin-up bar to allow the exerciser to push up with his legs as described in The Men's Health Home Workout Bible. This technique works well, however it is difficult for the exerciser to provide a consistent level of assistance and therefore more difficult for the exerciser to chart progress, an important part of most exercise routines.

Another technique is described in U.S. Pat. No. 4,111,414 to Roberts that discloses a cable and pulley system that is used to supply an upward body weight counteracting force to a harness that supports the exerciser. This system however, is not portable and fairly awkward to operate.

In addition, large complicated exercise machines with freestanding frames have also been developed to assist a user in performing a chin-up, a dip, or both. These systems offer a platform, pad or bar onto which a user must position the feet or knees that then helps raise the exerciser albeit subjected to the restricted armature motion of such devices. Examples of these include: U.S. Pat. No. 5,407,404 to Killian et al.; U.S. Pat. No. 5,011,139 to Towley, III; U.S. Pat. No. 4,849,458 to Potts; U.S. Pat. No. 5,322,489 to Webb et al.; U.S. Pat. No. 5,372,556 to Ropp; and U.S. Pat. No. 5,499,959 by Holmes et al.

All these devices counteract a percentage of the users body weight by providing a vertical force and thereby allow the user to perform the exercise by lifting only a select percentage of their body weight. While these machines can be very helpful, they can also be awkward and unnatural to use and they are large, complicated, expensive, certainly not portable, and usually only found in very well stocked gyms and fitness centers.

Therefore there remains a need for a device that can easily transform the other more simple and prolific pieces of exercise equipment for performing chin-ups and dips into assisted exercise stations offering relative safety and comfort so that users of all levels can benefit from these exercises wherever this equipment is located. This would allow exercisers to perform these exercises within the home or at gyms and fitness centers equipped with basic equipment and therefore avoid the inconvenience and/or the expense of travelling to a specific gym that has such equipment. Preferably such a device would also be both multi-functional and portable.

Exercise devices offering multi-functionality and portability have become popular for exercising in the home and on travel. However many multi-function, portable exercise devices are neither truly multi-function nor portable and therefore to obtain a good full-body workout using this type of equipment may require the person to carry a number of different pieces of equipment—an expensive solution and a contradiction to travelling light.

One category of truly multi-functional, portable exercise equipment possesses extensible, elastomeric lengths of material that create elastic resistances in order to work the muscles. The most common type of device in this category possesses a length of elastic rubber tubing approximately four to five feet long and terminated by a securely connected handle at each end for the user to grasp. The user can truly perform a number of different resistance exercises with this type of device by stretching the tubing in a variety of directions and using a variety of engagement techniques to work different muscle groups.

Various adaptations on this theme have arisen mostly to specialize on a different variety of exercise choices. Some examples of these include: U.S. Pat. No. 4,852,874 issued to Sleichter et al.; U.S. Pat. No. 5,108,096 issued to Ponce; U.S. Pat. No. 5,681,248 issued to Vani; and U.S. Pat. No. 6,244,998 issued to Hinds. While these portable devices possess varied degrees of multi-functionality, some are specifically designed for a single exercise making true multi-functionality awkward and cumbersome and none of these are designed to offer assistance for both the chin-up and dip.

Therefore there still remains the need for a device that is highly portable and functional such that it can assist an exerciser in performing a variety of highly beneficial full body weight exercises such as the chin-up and dip on any piece of equipment suitably designed for such exercises as well as offer the functionality and features that enable the exerciser to perform other traditional resistance exercises with only small changes in the devices configuration.

BRIEF SUMMARY OF THE INVENTION

It is therefore a principle object and purpose of the present invention to provide a multi-functional, portable and inexpensive exercise apparatus for working various muscles that can also assist an exerciser perform chin-ups and dips by providing a comfortable upward force opposite the force of gravity to offset a portion of the exerciser's body weight and therefore make these exercises easier.

It is another object of the present invention to provide a fitness device able to adapt to standard chin-up and dip equipment and transform them into assisted chin-up and dip stations.

It is another object of the present invention to synergistically combine the exercise functionality and portability of elastic rubber tubing with the exercise functionality and practicality of the preferred embodiment of the device in U.S. patent application Ser. No. 10/456,546 by the same applicant in order to obtain an interchangeable exercise device offering new functionality.

It is another object of the present invention to provide an assisted chin-up and dip exercise apparatus that is safe, relatively compact, and that permits natural body movement during the exercise.

It is yet another object of the present invention to provide a transportable and comfortable means of offering a greater degree of resistance for various exercises such as the push-up.

These and other objects, features, and advantages of the present invention are provided by an exercise apparatus including interchangeable extensible, elastomeric links releasably secured to either side of an inelastic and flexible sling and whereas the elastomeric links are also releasably secured, at their other ends, to the chin-up and/or dip exercise equipment and thereby suspending the sling beneath the operational positions of the user's hands during the exercise. In its fully attached operational configuration, the user engages a portion of his/her body within the suspended sling (the lower part of the leg, just below the bent knee is a natural and convenient place since a tucked leg position is a natural position for a person performing these exercises) and proceeds with the exercises. The elastic members stretch as the user lowers him/herself until at the fully lowered position the weight counteracting elastic members are at their most fully extended position during the exercise. This elastic force then helps lift the exerciser back to the starting position for one repetition.

The elastic stretch members can be lengths made of any form factor design of elastic product such as bands, tubing, or any similar material such as bungee cord. Different lengths are possible to provide for various size differences in the users and for any differences needed to perform various exercises. Various elastic resistances are also possible to provide for various levels of desired assistance while performing the exercises.

The inelastic, flexible sling component can be made of any type of fabric, textile, nylon or similar material.

The various attachment mechanisms allow for easy assembly/disassembly with any standard chin-up and/or dip piece of exercise equipment.

DETAILED DESCRIPTION OF THE INVENTION

The present invention will now be described more fully hereinafter with reference to the accompanying drawings, in which a preferred embodiment of the invention is shown in detail for one particular exercise—the chin-up. It should be noted that only slight configuration modifications and positioning of the invention are necessary to provide benefits for other exercises such as the dip as previously described. Some of these varied configurations and positioning instructions will be presented towards the end of this description. This invention may, however, be embodied in many different forms and should not be construed as limited to the embodiment set forth herein. Rather, applicant provides this embodiment so that this disclosure will be thorough and complete, and will fully convey the scope of the invention to those skilled in the art. Like numbers refer to like elements throughout. Any gender related pronouns or references are meant to be interchangeable throughout to mean a user of the exercise apparatus. Chin-ups and pull-ups are meant to be interchangeable terms for the description of either exercise.

Figure 1:
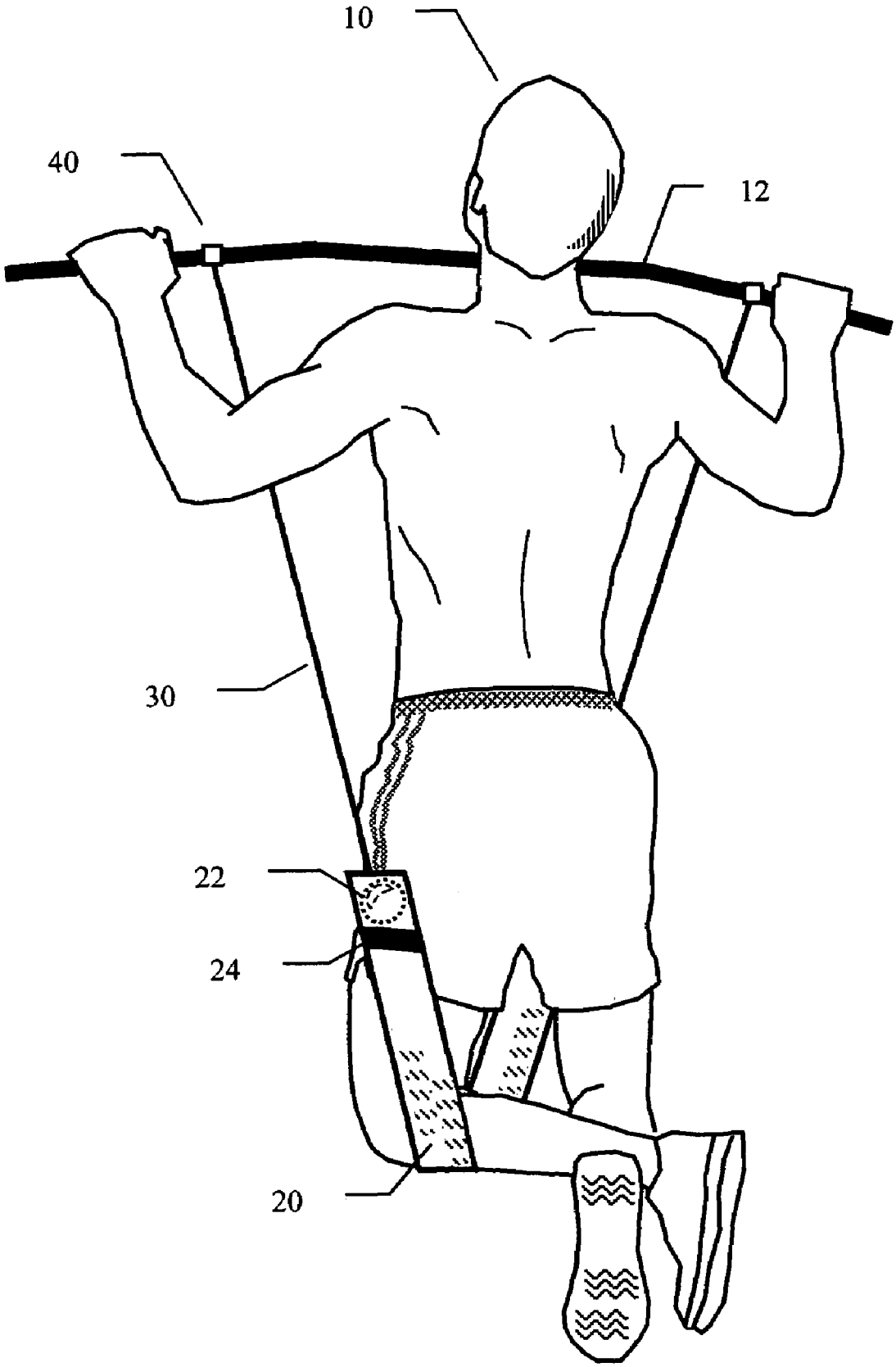
FIG. 1 generally shows a perspective view of an individual using the invention for chin-up assistance.

FIG. 1 generally shows the exerciser position and use of the chin-up/pull-up assistance apparatus. The exerciser 10 is gripping onto a securely mounted chin-up bar 12 from a hanging position. The inelastic and flexible sling 20 is engaged with the exerciser's left leg just below his knee where it is securely positioned via the angle the leg is held. The sling 20 is securely yet releasably attached (via a tubing attach mechanism 24) to a length of elastic rubber tubing 30 (or any similarly functioning extensible, elastomeric device made of natural and/or synthetic material) at each of its ends. Preferably the other end of the elastic rubber tubing elements 30 are securely yet releasably attached to positions on the chin-up/pull-up bar 12, or any other appropriate anchor position, by way of attachment mechanism 40. The attachment mechanism 40 can be any suitable tubing attachment object or technique to allow secure yet releasable connection points for the tubing. The elastic rubber tubing lengths 30 preferably supply equivalent elastic resistance to each side of the sling 20. The exerciser 10 uses the present invention by engaging a part of the body within the sling 20 and then performing chin-ups in the normal fashion.

The invention has a variety of possible configurations for assisting the chin-up. Therefore, it is conceivable that only one attachment mechanism 40 is used to attach the elastic rubber tubing 30 and/or that only one long length of elastic rubber tubing 30 is used. A longer single piece of tubing could conceivably be looped over the bar 12 as its attachment mechanism 40, or it could be securely attached via another technique.

The preferable choice of at least one of the components included with the invention will enable a variety of configuration changes to change the hanging distances for the sling 20. These variable components could include variable lengths, or positioning choices, for any of the attachment mechanisms or variable lengths for the elastic tubing elements 30. The variety of choices for hanging distances will allow users of varying sizes to properly use the invention. The preferred operational positioning for the sling 20 is such that only a light tension will hold the sling 20 against the engaged body part at the top of the exercise range of motion. As the exerciser lowers himself, the increasing upwardly directed tension on the sling 20 offsets an increasing portion of the user's body weight thus making the performance of the exercise easier.

The upward forces supplied by the elastic rubber tubing elements 30 that make the exercises easier are fully exchangeable to enable different levels of assistance as well as to provide for regular wear replacement. The overall elastic resistance can be modified by exchanging single tubing elements 30 of varying strengths or by utilizing multiple tubing elements 30 on each side of the sling 20. In the latter case the tubing elements 30 could be of the same, or of differing strengths.

The stronger the elastic resistance, the more assistance the device will supply to the exerciser 10. Therefore it is envisioned that as an exerciser develops himself he will progressively begin to lessen the elastic resistance to make the exercise harder and therefore continue to develop over time. Eventually, full body weight exercises may be possible. Conversely, within any single exercise session fatigue will quickly set in while doing chin-ups; so in this situation it is conceived that the exerciser could progressively add elastic resistance to increase assistance and therefore continue to obtain the benefits from additional repetitions of the full exercise motion with a smaller percentage of body weight being lifted.

Figure 2:
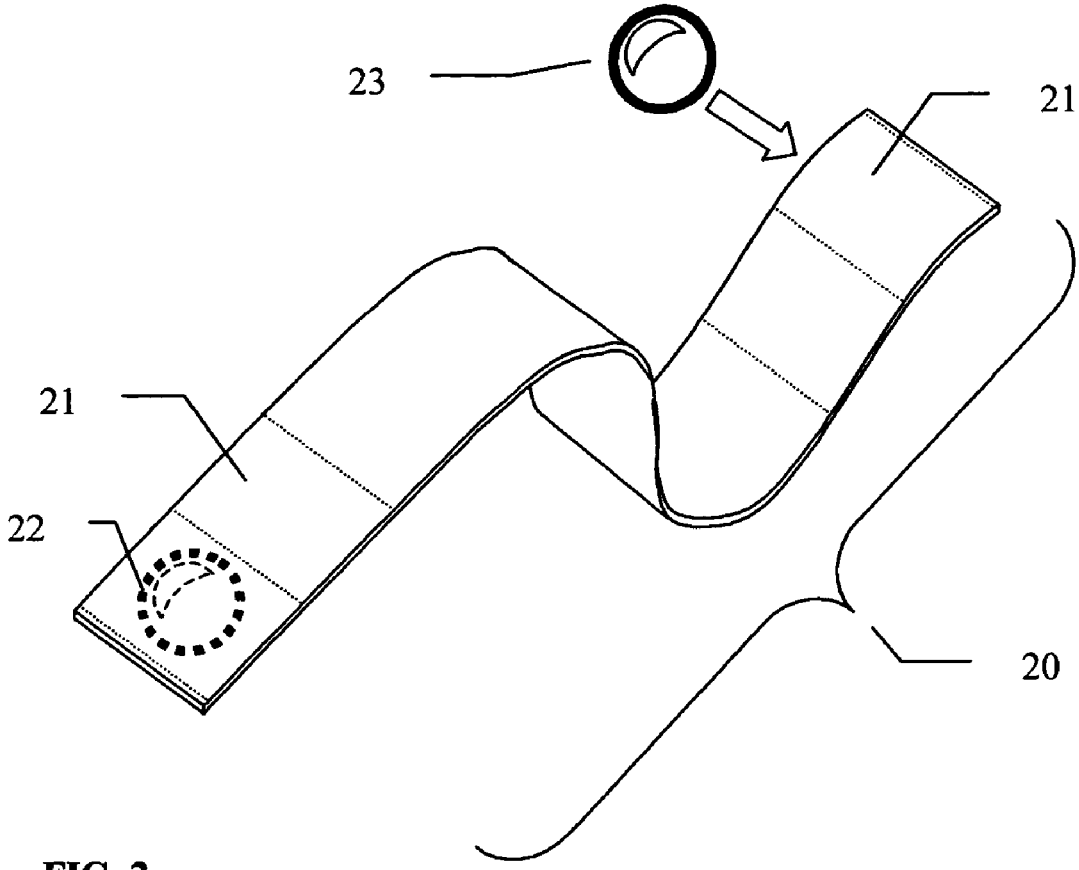
FIG. 2 shows the various components that make up the preferred embodiment of the sling.

Referring now to FIG. 2 of the drawings, the inelastic flexible sling 20 can be made from any one of a number of comfortable materials (i.e. textile, nylon, nylon reinforced neoprene, leather, etc.), in any one of a number of shape configurations, and have any one of a number of differing types of known attachment mechanisms to the elastic rubber tubing elements 30 (possibilities include grommets, clips, loops, etc.). However, a preferred embodiment of the sling 20 is a flexible and substantially non-stretchable length of material with pockets 21 provided substantially at each end of the device wherein the provision of at least one grip enhancing component 23 within a pocket creates an anti-slip grip 22 for an engagement means at least partially encircling the width of the device.

This preferred embodiment of the sling 20, as disclosed in U.S. patent application Ser. No. 10/456,546 by the same applicant, provides an additional level of exercise multi-functionality as the sling itself acts as a highly functional strength and flexibility training apparatus on its own. Furthermore, and also described in this aforementioned application, a sling 20 made substantially of terry cloth towel fabric (or any similar water absorbing material) will add yet another level of multi-functionality since exercisers frequently carry towels with them as they exercise.

Figure 3:
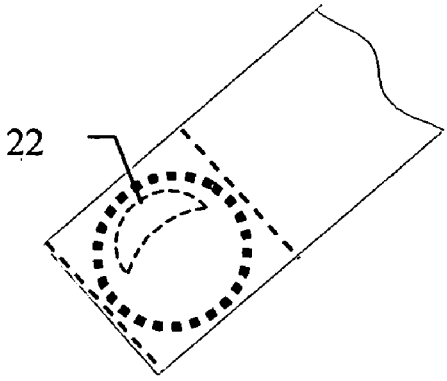
FIG. 3 depicts one end of the sling showing the anti-slip grip.
Figure 4:
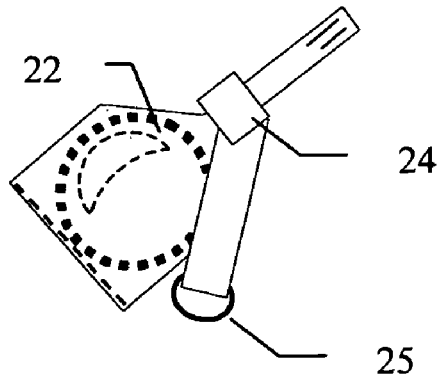
FIG. 4 depicts detail of one possible sling engagement mechanism.

Referring now to FIG. 3 we see the end of the sling 20 with the grip-enhancing element inserted within the pocket to create the anti-slip grip 22. FIG. 4 then depicts the application of a preferred embodiment of a tubing attach mechanism 24 against the anti-slip grip 22. The tubing attach mechanism 24 could be applied by either wrapping it transversely around the sling 20 at the point of the anti-slip grip 22 and releasably securing it with a material such as Velcro®, or the end of the sling 20 could be inserted through a loop of the tubing attach mechanism 24 with the grip enhancing component 23 inserted afterward to lock it in place. A tubing attachment site D-ring 25 resides on this embodiment, indicating that the rubber tubing element 30 is provisioned with a complementary means of attachment, such as a clip, slip loop or any other such means. Any type of complementary attachment mechanism between the tubing elements 30 and the sling 20 is possible.

Figure 5:
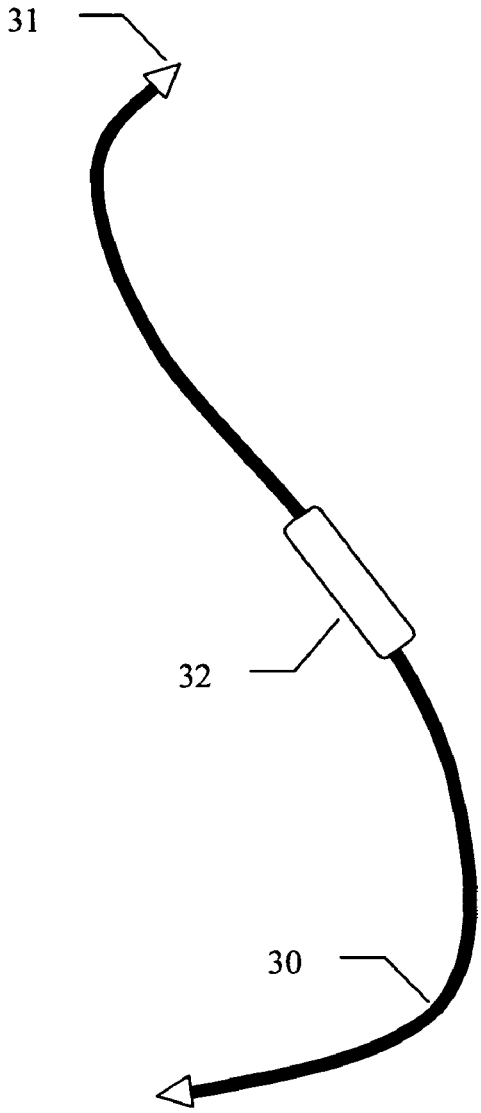
FIG. 5 illustrates one possible elastic rubber tubing configuration with clips and handgrip that can be associated with the invention.
Figure 6:
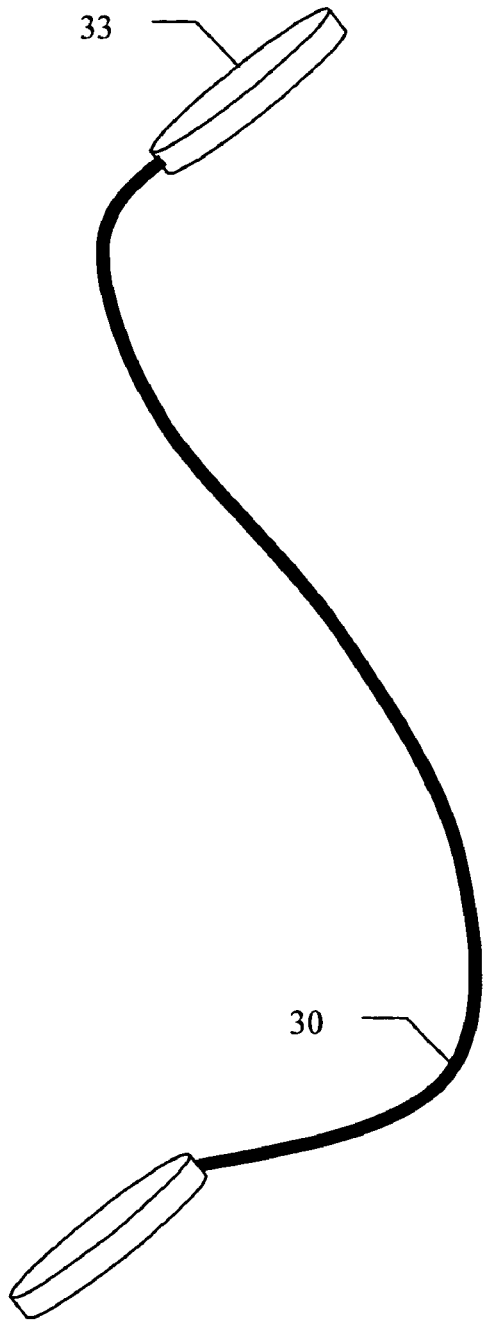
FIG. 6 shows another possible elastic rubber tubing configuration with slip loops.

FIG. 5 and FIG. 6 illustrate some embodiments of the rubber tubing element 30 termination choices that can accompany the invention. The embodiment in FIG. 5 depicts clips 31 and FIG. 6 depicts slip loops 33 that can be used to releasably secure one end of the tubing to the sling's rubber tubing attachment site 25 and the other end to the upper attachment mechanism 40 in FIG. 1, or any other suitable anchor point. Any combination of these termination choices or any other suitable termination attachment mechanism could be used. It is also conceived that the termination component could also directly attach the rubber tubing element directly to the sling 20 and/or the overhead attachment point on the chin-up bar 12, or any other appropriate anchor position. It is also conceived that no attachment mechanisms are used, but that the rubber tubing is tied directly to the sling 20 and/or the chin-up bar 12, or any other appropriate anchor position.

The rubber tubing elements 30 are removable and interchangeable for a number of independent and interrelated reasons. Firstly, so that different levels of elastic resistances may be employed to accommodate users of different weights and/or personal strength. Secondly, such that different levels of elastic resistances may be employed to accommodate different exercise configurations. Thirdly, so that different lengths of tubing 30 may be utilized to accommodate users of different sizes. Fourthly, so that different lengths of tubing 30 may be used to accommodate different exercise configurations. Fifthly, so that the tubing elements 30 may be replaced as a result of normal wear. Sixthly to disassemble for transport and/or usage purposes. The rubber tubing elements 30 may also possess integrated length adjustment mechanisms in order to vary the length of the tubing elements 30. Various techniques are employed for this purpose, including those that secure the tube at various points through pinching mechanisms.

In the preferred embodiment, certain rubber tubing elements 30 will also have a handgrip element 32 associated with it as depicted in FIG. 5. While the these handgrip elements 32 are not necessary, they will add extra comfort for the user and protection for the elastic rubber tubing in some exercise configurations and they will not impair the use of the chin-up assistant configuration of FIG. 1. The handgrip element 32 is preferably cylindrically shaped (or of any hollow construction shape) with a longitudinally extending aperture through which the rubber tubing element 30 is directed. The handgrip element 32 is preferably made of a comfortable and durable foam and/or rubber type of substance such as polyurethane or neoprene that is substantially nonabrasive to the tubing element 30 and it may be stationary in a central position along the length of the tubing element 30, it may have the ability to freely slide along it, and it may even be removable from the rubber tubing element 30.

Figure 7:
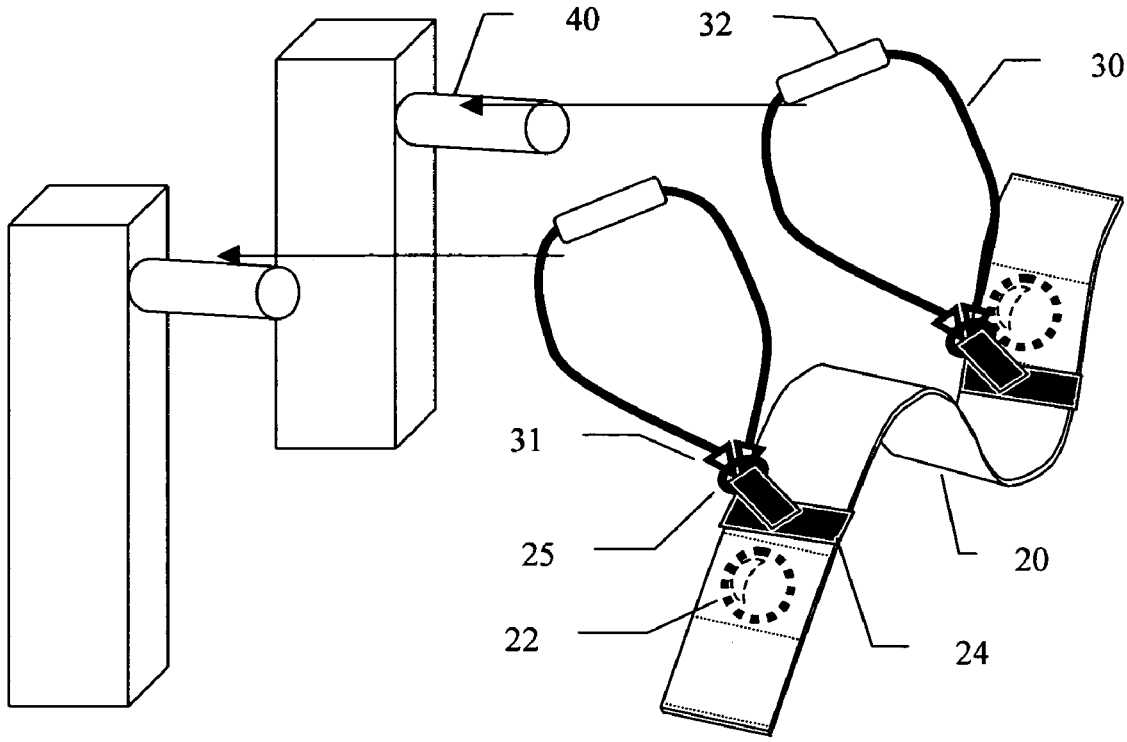
FIG. 7 depicts a dip exercise configuration.
Figure 8:
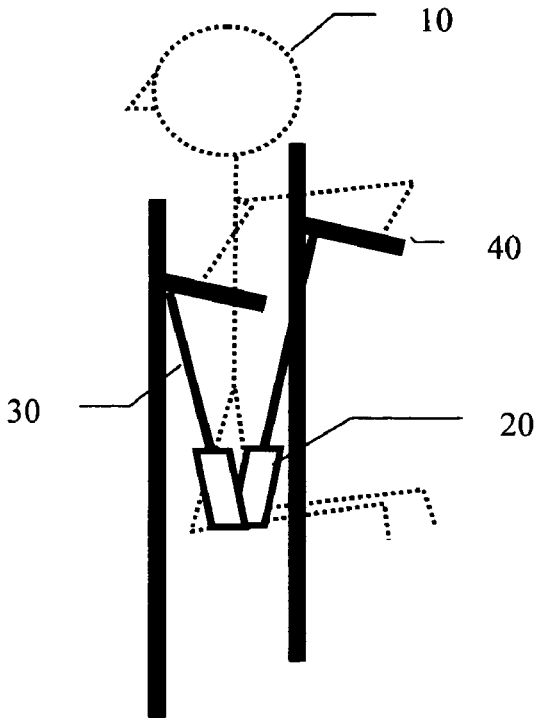
FIG. 8 illustrates the operational usage of a dip assist configuration.

FIG. 7 illustrates one possible configuration that is useful for aiding the dip exercise and a depiction of that configuration's operational usage is illustrated in FIG. 8. As can be seen in FIG. 7 the only changes in the configuration that are necessary from the chin-up assist configuration of FIG. 1 are attaching both ends of the rubber tubing elements 30 to the sling attachment device 24 and adjusting the positioning of the sling attachment device 24 such that it is positioned appropriately for the dip exercise. The looped rubber tubing elements 30 are placed over the separated parallel dip handles 40 so that the sling 20 is suspended between them. The handgrip elements 32 help to protect the tubing 30. Referring to FIG. 8, the sling 20 should be positioned such that it is rests against the lower part of the bent leg, just below the knee of the user at the top of the exercise maneuver, as it was positioned with the chin-up. Then as the user lowers himself the stretched rubber tubing elements 30 provide the upward vertical force to offset the total body weight of the user and therefore make the exercise easier.

Assistance in performing the dip exercise can be achieved using a variety of configurations. One other such configuration can be much like that depicted in FIG. 1 if suitable overhead attachment anchor points exist for the elastic tubing elements 30.

Figure 9:
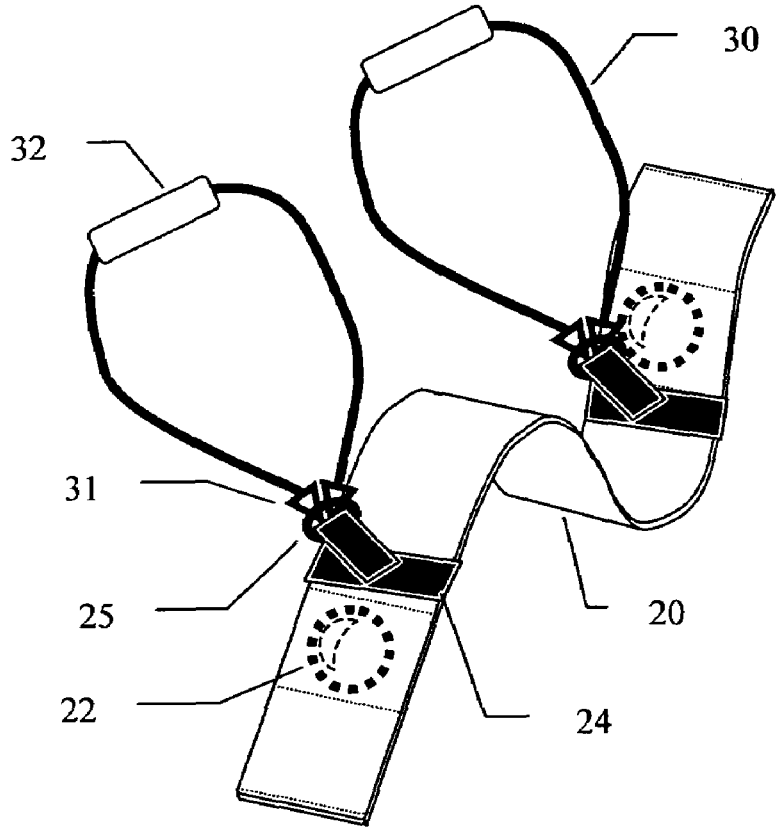
FIG. 9 generally shows a configuration to add resistance to the push-up exercise.
Figure 10:
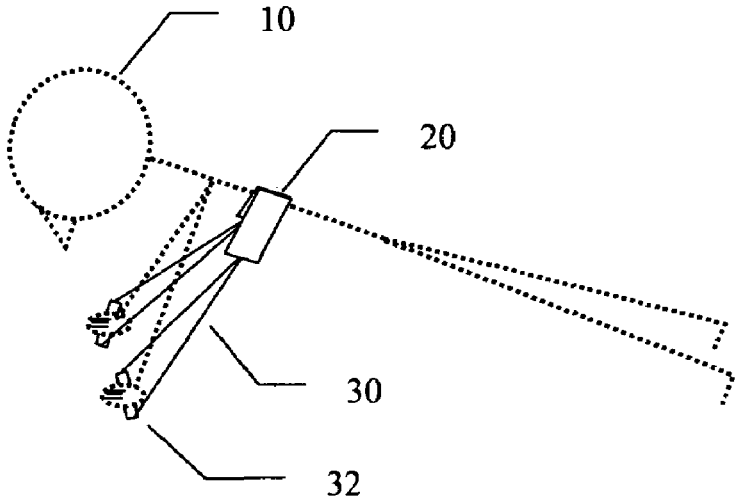
FIG. 10 illustrates an operational usage diagram for a common form of the push-up.

As previously mentioned, the present invention is a multi-functional fitness device and therefore can be used for a variety of different exercises under various configurations. FIG. 9 illustrates one possible configuration that is useful for providing added resistance to the common push-up and a depiction of that configuration's operational usage is illustrated in FIG. 10. As can be seen in FIG. 9, this configuration is much like that of FIG. 7 however in this configuration's usage the sling 20 is placed behind the back of the user with the looped rubber tubing elements 30 extended under the arms of the user and gripped out in front with each hand. While securing the central portion of the looped rubber tubing element 30 to the floor the user proceeds to perform the normal push-up while experiencing the added resistance provided by the invention. The preferred embodiment in this configuration contains the handgrips 32 as they help to cushion the hands from the resistive force of the tubing. The configuration of FIG. 9 is also useful for performing seated rowing exercises among others.

Further modifications to the configuration of the invention and addition of complementary components such as clip on handles, inelastic tubing connectors, exercise bars, or even additional slings 20 among other items enable an even wider variety of resistance exercises, such as: military presses, bicep curls, triceps extensions, lateral raises, and squats among many others.

The configuration adaptations can be better understood by way of a couple examples that will be apparent to those skilled in the art of exercise and fitness.

EXAMPLE 1

The military press is performed by sliding at least one of the sling attachment devices 24 to the middle of the sling 20 and then attaching two appropriately sized elastic rubber tubing elements 30 (each possessing a clip-on handles at the opposite end) to this central site. Then the user stands on the sling 20 just inside the anti-slip grips 22 to secure the entire apparatus and presses the handles overhead to perform the exercise.

EXAMPLE 2

Bicep curls are performed by attaching an appropriately sized and handled elastic tubing element 30 to each end of the sling 20 just inside the anti-slip grips 22, then by standing on the sling 20 with the feet comfortably positioned between the tubing attachment mechanisms 24 the user can perform bicep curls.

Another benefit exhibited with the configurations highlighted here enable a user to perform these resistance exercises comfortably and safely without shoes. Since some current exercise trends such as yoga and Pilates are commonly performed without shoes these strength-building exercises could easily be integrated into such programs.

Although the present invention has been described with particularity relative to the foregoing detailed description of the preferred embodiments, there are other various modifications, changes, additions and applications other than those specifically mentioned herein that will be readily apparent to those having normal skill in the art without departing from the spirit and scope of this invention as defined by the appended claims.

I claim:

1. Exercise equipment including a chin/pull-up exercise assist apparatus for use with an exerciser having a frontal lower leg and hands comprising:

an overhead chin-up exercise bar enabling the exerciser to execute standard full bodyweight chin-ups;

a chin-up assist apparatus comprising an elongated element having first and second ends, each of said first and second ends releasably attached to the overhead exercise bar thereby suspending the assist apparatus between the first and second ends;

said elongated element having at least one extensible elastomeric component;

a non-rigid, U-shaped sling adapted to receive therein the frontal lower leg between the ankle and the knee of the user;

said sling coupled to said at least one elastomeric component and positioned substantially centrally of the first and second ends;

wherein the at least one suspended elastomeric component provides an elastic resistance to create an upward force during performance of the chin/pull-up to offset a portion of an exerciser's body weight and thereby assist the exerciser in performing the chin/pull-up.

2. The chin/pull-up exercise assist apparatus of claim 1 wherein the overhead chin-up exercise bar comprises a standard bar.

3. The chin/pull-up exercise assist apparatus of claim 1 wherein the overhead chin-up exercise bar is doorway mounted.

4. The chin/pull-up exercise assist apparatus of claim 1 wherein the overhead chin-up exercise bar is integrated with other exercise stations as part of a multi-function exercise unit.

5. The chin/pull-up exercise assist apparatus of claim 1 wherein a longitudinally hallow device having two ends is longitudinally fitted around the at least one extensible elastomeric component on each side of the U-shaped sling wherein the at least one extensible elastomeric component can stretch beyond the two ends of the longitudinally hollow device.

6. The chin/pull-up exercise assist apparatus of claim 1 wherein the U-shaped sling is made of at least one type of water absorbing material or fabric such that when it is disengaged from the apparatus it can function as a gym towel.

7. The chin/pull-up exercise assist apparatus of claim 1 wherein the U-shaped sling is releasably suspended from the overhead chin-up exercise equipment by at least one extensible elastomeric component attached between each end of the sling and the overhead chin-up exercise equipment.

8. The chin/pull-up exercise assist apparatus of claim 1 wherein the at least one extensible elastomeric component is exchangeable.

9. The chin/pull-up exercise assist apparatus of claim 1 wherein suspension length adjustability is achieved by at least one of adjustable length components and spaced component attachment points on the apparatus.

10. Exercise equipment including a chin/pull-up exercise assist apparatus for use with an exerciser having a frontal lower leg and hands comprising:

securely mountable, overhead chin-up exercise equipment including an overhead chin-up bar enabling the exerciser to execute standard full bodyweight chin-ups;

a chin-up assist apparatus comprising an elongated element having first and second ends, each of said first and second ends releasably attached to the chin-up equipment thereby suspending the assist apparatus between the first and second ends;

said elongated element having at least one extensible elastomeric component;

a non-rigid, U-shaped sling adapted to receive therein the frontal lower leg between the ankle and the knee of the user;

said sling coupled to said at least one elastomeric component and positioned substantially centrally of the first and second ends;

wherein the at least one suspended elastomeric component provides an elastic resistance to create an upward force during performance of the chin/pull-up to offset a portion of an exerciser's body weight and thereby assist the exerciser in performing the chin/pull-up.

11. The chin/pull-up exercise assist apparatus of claim 10 wherein a longitudinally hollow device having two ends is longitudinally fitted around the at least one extensible elastomeric component on each side of the U-shaped sling wherein the at least one extensible elastomeric component can stretch beyond the two ends of the longitudinally hollow device.

12. The chin/pull-up exercise assist apparatus of claim 10 wherein the U-shaped sling is releasably suspended from the overhead chin-up exercise equipment by at least one extensible elastomeric component attached between each end of the sling and the overhead chin-up exercise equipment.

13. The chin/pull-up exercise assist apparatus of claim 10 wherein the at least one extensible elastomeric component is exchangeable.

14. The chin/pull-up exercise assist apparatus of claim 10 wherein suspension length adjustability is achieved by at least one of adjustable length components and spaced component attachment points on the apparatus.

15. Exercise equipment including a chin/pull-up exercise assist apparatus for use with an exerciser having a frontal lower leg and hands comprising:

securely mounted, overhead chin-up exercise equipment including an overhead chin-up bar enabling the exerciser to execute standard full bodyweight chin-ups;

a chin-up assist apparatus comprising an elongated element having first and second ends, each of said first and second ends releasably attached to the chin-up equipment thereby suspending the assist apparatus between the first and second ends;

said elongated element having at least one extensible elastomeric component;

a non-rigid, U-shaped sling adapted to receive therein the frontal lower leg between the ankle and the knee of the user;

said sling coupled to said at least one elastomeric component and positioned substantially centrally of the first and second ends;

wherein the at least one suspended elastomeric component provides an elastic resistance to create an upward force during performance of the chin/pull-up to offset a portion of an exerciser's body weight and thereby assist the exerciser in performing the chin/pull-up.

16. The chin/pull-up exercise assist apparatus of claim 15 wherein the overhead chin-up exercise equipment is integrated with other exercise stations as part of a multi-function exercise unit.

17. The chin/pull-tip exercise assist apparatus of claim 15 wherein a longitudinally hollow device having two ends is longitudinally fitted around the at least one extensible elastomeric component on each side of the U-shaped sling wherein the at least one extensible elastomeric component can stretch beyond the two ends of the longitudinally hollow device.

18. The chin/pull-up exercise assist apparatus of claim 15 wherein the U-shaped sling is releasably suspended from the overhead chin-up exercise equipment by at least one extensible elastomeric component attached between each end of the sling and the overhead chin-up exercise equipment.

19. The chin/pull-up exercise assist apparatus of claim 15 wherein the at least one extensible elastomeric component is exchangeable.

20. The chin/pull-up exercise assist apparatus of claim 15 wherein suspension length adjustability is achieved by at least one of adjustable length components and spaced component attachment points on the apparatus.

* * * * *